US006008583A

United States Patent [19]

Breuer et al.

[11] Patent Number: 6,008,583

[45] Date of Patent: Dec. 28, 1999

[54] DISCHARGE LAMP WITH SECONDARY IGNITION ELECTRODE

[75] Inventors: Uwe Breuer, Wehrheim; Peter Gernhard, Friedrichsdorf; Steffen Oppawsky, Bad Homburg; Dieter Schödel, Wiesbaden, all of Germany

[73] Assignee: Heraeus Kulzer GmbH, Hanau, Germany

[21] Appl. No.: 08/902,852

[22] Filed: Jul. 30, 1997

[30] Foreign Application Priority Data

Aug. 2, 1996 [DE] Germany ..... 196 31 188

[51] Int. Cl.[6] ..... H01J 17/44; H01J 61/54

[52] U.S. Cl. ..... 313/594; 313/113; 313/607; 313/234; 362/263

[58] Field of Search ..... 313/113, 114, 313/634, 594, 607, 234; 315/241 P, 237; 362/263

[56] References Cited

U.S. PATENT DOCUMENTS

| | | | |
|---|---|---|---|
| 3,692,994 | 9/1972 | Hirschman et al. | 313/234 |
| 3,733,599 | 5/1973 | Fantozzi | 315/237 |
| 4,001,624 | 1/1977 | Cosco et al. | 313/594 |
| 4,004,189 | 1/1977 | Cosco et al. | 313/594 |
| 4,342,940 | 8/1982 | Mrusko et al. | 313/594 |
| 4,785,216 | 11/1988 | Roberts et al. | 313/113 |
| 4,941,070 | 7/1990 | Ogawa et al. | 313/594 |

FOREIGN PATENT DOCUMENTS

| | | | |
|---|---|---|---|
| 0 002 848 | 7/1979 | European Pat. Off. | H01J 61/54 |
| 0 049 466 | 4/1982 | European Pat. Off. | H01J 61/54 |
| 76 236 | of 0000 | France . | |
| 1764866 | of 0000 | Germany | H01J 61/54 |
| 2230221 | of 0000 | Germany | H01J 61/54 |
| 2646577 | of 0000 | Germany | H01J 61/54 |
| 2903993 | of 0000 | Germany | F21V 7/12 |
| 3642413 | of 0000 | Germany | H05B 41/02 |
| 3718216 | of 0000 | Germany | H01J 61/76 |
| 37 18 216 A1 | 12/1987 | Germany | H05B 41/02 |
| 57-123642 | 8/1982 | Japan | H01J 61/54 |
| 57-123643 | 8/1982 | Japan | H01J 61/54 |
| 01045040 | 2/1989 | Japan | H01J 9/24 |
| 1361073 | of 0000 | United Kingdom . | |

*Primary Examiner*—Michael Day
*Attorney, Agent, or Firm*—Sprung Kramer Schaefer & Briscoe

[57] ABSTRACT

A discharge lamp includes a lamp tube containing a noble gas, two internal electrodes, and a secondary electrode disposed outside and close to the surface of the lamp tube. In one embodiment, studs are disposed on the lamp tube so as to affix the secondary electrode. In an alternate embodiment, a reflector includes an indentation pointing toward the lamp tube and configured as the secondary ignition wire.

9 Claims, 2 Drawing Sheets

DISCHARGE LAMP WITH SECONDARY IGNITION ELECTRODE

BACKGROUND OF THE INVENTION

The invention relates to a discharge lamp arrangement with a lamp tube in which a noble gas is contained, having two internal electrodes arranged in the tube, and having a secondary ignition electrode which is outside of the tube and is disposed outstretched lengthwise close to its surface.

Such arrangements are disclosed, for example, in EP 0 049 466 A2. In the latter the secondary ignition electrodes required for the operation of the discharge lamps are in the form of a conductor disposed along the discharge lamp, which is mounted either by means of clips at opposite ends of the lamp, or the secondary ignition electrode is mounted on the lamp socket and carried as a wire along the lamp tube. Furthermore, secondary ignition electrodes are explained which are wound spirally or mesh-like around the tubes. These arrangements are relatively complicated to manufacture, for example due to the necessary complicated socket configuration, or due to the complicated arrangement of the ignition electrode directly on the tube. The arrangements described tend, on account of the electromagnetic forces developing during the operation of the discharge lamp, to migrate around the tube, so that the deposits forming during operation of the lamp are not restricted to a small area of the lamp, and instead gradually cause more or less severe darkening over the entire circumference, so that the useful life of the discharge lamps is very limited. This makes the operation of these discharge lamps expensive, not to mention the complication created by the arrangement of the secondary ignition electrodes in manufacturing them.

Similar arrangements are disclosed in DE 37 18216 A1. Such arrangements are used with a noble gas charge (e.g., xenon) also as stroboscope lamps. The secondary ignition electrode is applied in the form of a conductor strip directly on the external surface of the tube. Such an arrangement is subjected to severe thermomechanical stresses. Differences in expansion coefficients between the conductor strip and the light tube can result in damage to the ignition electrode.

SUMMARY OF THE INVENTION

Setting out from the state of the art described above, the invention is addressed to the problem of developing a discharge lamp arrangement with a secondary ignition electrode of this kind which on the one hand can be manufactured at low cost, and on the other will reliably assure a long useful life of the discharge lamp.

This problem is solved according to the invention in that studs are disposed on the lamp tube, on which the secondary ignition electrode lies. In particular, these studs can consist of the same material as the tube. Such arrangements are very easy to realize. The secondary electrode can be affixed by means of the studs, so that it does not wander over the circumference of the tube. Complicated precautions intended to assure tight contact between the secondary ignition electrode and the tube are unnecessary even when the tube is used as a stroboscope lamp.

Preferably, the studs are created in pairs and disposed on both sides of the secondary ignition electrode. In the case, for example, of a weave-like wrapping of the tube, the crossovers of the weave can be affixed by two studs holding the wire between them. The studs can also be arranged in alternation on both sides of the secondary ignition electrode.

It is also possible for at least one stud to be provided which extends away from the surface of the tube and has at its end remote from the tube a portion that is thicker than the stud on the tube, the secondary ignition electrode being wound at least once around the stud. Such a stud is in the shape of a mushroom. This arrangement has the advantage that the secondary ignition electrode does not have to be fastened around the circumference of the tube; all that is needed is a rectilinear configuration along the tube, since secure contact with the tube is assured by the mushroom shape of the stud.

In another embodiment of the invention the tube is disposed in a lamp housing wherein the secondary ignition electrode is mounted on the lamp housing. The lamp housing (also called "light body") has a permanently installed secondary ignition electrode. This is installed once for all and remains even when the tube is changed. This means that the discharge lamp itself can be made substantially more simple and thus can be manufactured at lower cost, and the fixation of the secondary ignition electrode on the lamp housing assures a permanent position relative to the lamp tube, so that the deposition phenomena referred to above remain limited to a small area. In addition, in an arrangement of this kind, more reliable contact with the secondary ignition electrode is assured.

Expediently, the secondary ignition electrode can be configured as a resilient metal ring which can contact the lamp tube by virtue of its spring force. Vibrations of the tube that occur during operation of the discharge lamp arrangement are compensated by this springing property. It is also possible for the lamp housing to have a reflector extending along the tube and having a metallic area configured as a secondary ignition electrode. Especially, the reflector can be formed from a sheet metal or a metallic coating facing the tube. Preferably the reflector has a shape along the tube such that it can serve as a secondary ignition electrode facing the tube. Such a shape can be in the form of a strip, bolster or crease. Such arrangements are very simple to make and very reliable in operation. Moreover, such an arrangement has the advantage that the discharge lamp itself can be installed even by operating personnel in a virtually arbitrary manner without the need to be concerned about a particular position of the secondary ignition electrode.

Desirably, the space between the secondary ignition electrode and the tube in such arrangements amounts to about 0.1 to 0.2 mm so that, in the case of fixed reflectors also serving as secondary ignition electrodes, vibration of the tube will be unable to cause wear on the reflector.

The invention will be further explained herewith with respect to the drawings, wherein:

DETAILED DESCRIPTION OF THE INVENTION

Figure 1:
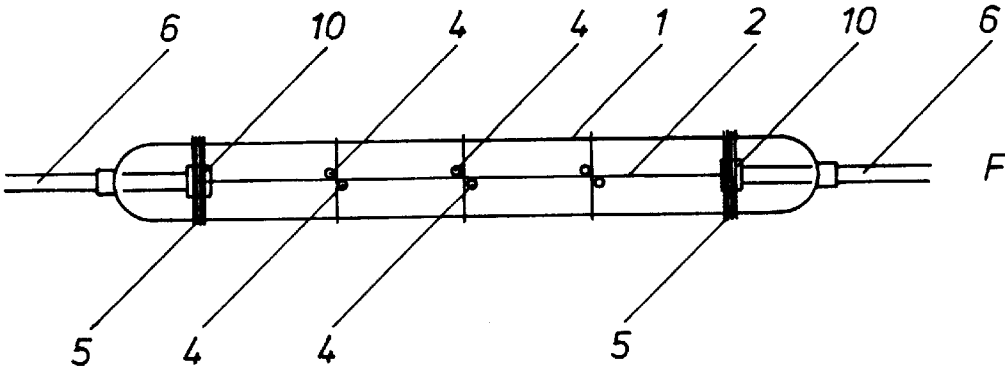
FIG. 1 shows the secondary electrode fastened to the lamp tube with studs in pairs.

For example, in the described state of the art, secondary ignition electrodes are disclosed which are wound around the tube in a looping manner. These can easily be affixed by the methods illustrated in FIGS. 1 and 2. The secondary ignition electrode 2 wound around the tube 1 is affixed at its crossovers 3 by studs 4. These studs 4 are made of the same material as the tube 1, i.e., glass. The clamping rings 5 of the secondary ignition electrode 2 serve at the same time as contacts, only one of them being connected. The corresponding contact is inside the lamp housing, and when the electrode 6 is connected to the lamp housing it is pressed by spring force against the corresponding clamping ring 5. The lamp electrodes 6 are brought through the wall of the tube 1 where they form the internal electrodes 10.

Figure 2:
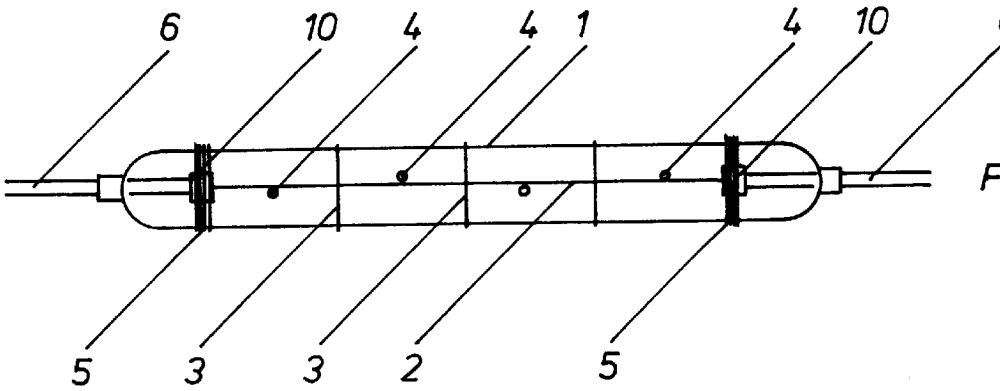
FIG. 2 shows how a secondary electrode is fastened to the lamp tube on studs in an alternating arrangement.

FIG. 2 shows a similar configuration. The studs 4, however, are alternated above and below the secondary ignition electrode 2, so that secondary ignition electrode 2 in this embodiment cannot shift around the tube 1.

Figure 3:
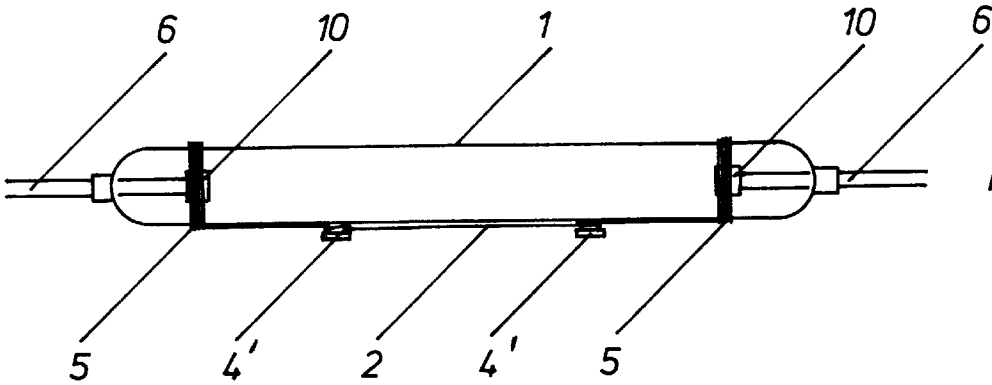
FIG. 3 shows how the secondary ignition electrode is fastened to the tube with one or more mushroom-shaped studs.

FIG. 3 shows a slightly different configuration. Two mushroom-shaped studs 4' are disposed on the tube 1. Around them the secondary ignition electrode 2 is wound. At the ends it is affixed with fastening rings 5 in a known manner. This secondary ignition electrode 2 cannot change its position at all or only slightly relative to the tube 1.

Figure 4:
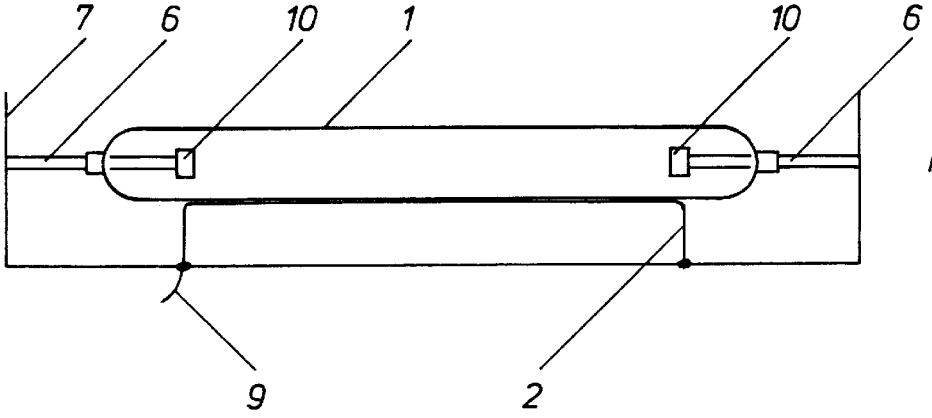
FIG. 4 shows a discharge lamp arrangement with a resilient secondary ignition electrode disposed on the lamp housing.
Figure 5:
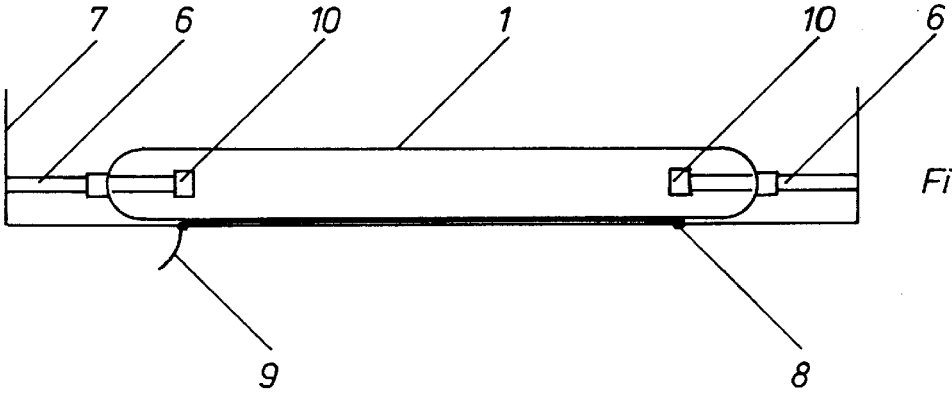
FIG. 5 shows a discharge lamp arrangement in which the reflector is configured as a secondary ignition electrode.

FIG. 4 shows another possibility for arranging the secondary ignition electrode 2. The discharge lamp is fastened by its electrodes 6 to the lamp housing 7. The lamp housing 7 also bears the secondary ignition electrode 2 which is in tight contact with the lamp housing 7 and thus it remains in the lamp system even when the lamp is replaced. The discharge lamp can thus be made in a substantially simpler and more inexpensive manner. In FIG. 5 is shown an additional possibility for the arrangement. Here the discharge lamp with its electrodes 6 is again fastened to the lamp housing 7. The bottom of the lamp housing 7 is configured as a reflector 8. The reflector 8 can be made of sheet metal or it can be provided with a metallic coating on its side facing the tube 1. It is connected through a contact 9 to the switching system. The switching system is designed in a common conventional manner and explained, for example, in the state of the art described above.

Figure 6A:
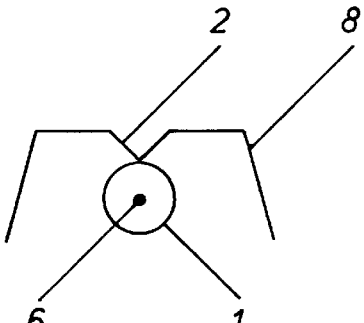
FIGS. 6*a*–6*c* show configurations of the secondary ignition electrode on the reflector as a crease, as a bolster or as a strip respectively.
Figure 6B:
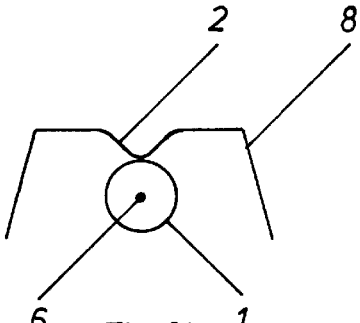
Figure 6C:
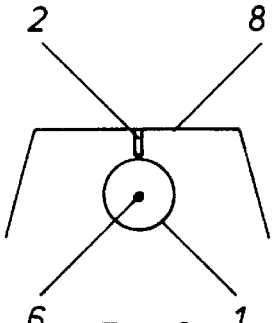

A concrete configuration of the secondary ignition electrode 2 as a component of the reflector 8 is shown in FIGS. 6*a–c*. The secondary ignition electrode 2 is in the form of a crease (FIG. 6*a*), a bolster (FIG. 6*b*) or a strip (FIG. 6*c*) and disposed directly on the reflector 8. Here, again, the secondary ignition electrode 2 runs along the length of the tube 1, between the two internal electrodes 10. The space between the secondary ignition electrode 2 and the lamp tube 1 is approximately 0.1 to 0.2 mm to prevent any friction on the reflector 8 in case of vibration of the lamp tube. To extend the secondary ignition electrode 2 with the same spacing beyond the electrodes 10 is not useful since in such cases flashovers between the internal electrode 10 and the secondary ignition electrode 2 are to be expected.

What is claimed is:

1. A discharge lamp arrangement comprising: a lamp tube in which a noble gas is contained; two internal electrodes disposed in the lamp tube; a secondary ignition electrode disposed outside the lamp tube and running along the lamp tube close to a surface thereof; and at least one stud disposed on the lamp tube, wherein the at least one stud extends away from the surface of the lamp tube and has a remote end which is thicker than a root at the surface of the lamp tube and wherein the secondary ignition electrode is wound at least once around the root of the at least one stud.

2. The lamp arrangement according to claim 1, wherein the at least one stud consists of the same material as the lamp tube.

3. A discharge lamp arrangement comprising: a lamp tube in which a noble gas is contained; two internal electrodes disposed in the lamp tube; a secondary ignition electrode disposed outside the lamp tube and running along the lamp tube close to a surface thereof; and pairs of studs disposed on the lamp tube and wherein each pair has one stud disposed on either side of the secondary ignition electrode.

4. The lamp arrangement according to claim 3, wherein the studs consist of the same material as the lamp tube.

5. A discharge lamp arrangement comprising: a lamp tube in which a noble gas is contained; two internal electrodes disposed in the lamp tube; a secondary ignition electrode disposed outside the lamp tube and running along the lamp tube close to a surface thereof; a lamp housing for the lamp tube and comprising a reflector extending along the length of the lamp tube; and wherein the reflector has a metal portion disposed outside the lamp tube and running along the lamp tube close to the surface thereof with an indentation pointing toward the lamp tube and configured as the secondary ignition electrode.

6. The discharge lamp arrangement according to claim 5, wherein the reflector is formed from sheet metal.

7. The discharge lamp arrangement according to claim 5, wherein the reflector has a metallic coating facing the lamp tube.

8. The discharge lamp arrangement according to claim 5, wherein the indentation is configured as one of a strip, a bolster and a crease.

9. The discharge lamp arrangement according to claim 5, wherein the distance between the secondary ignition electrode and the surface of the lamp tube is about 0.1 to 0.2 mm.

* * * * *